US010413003B2

(12) United States Patent
Kimbrough

(10) Patent No.: US 10,413,003 B2
(45) Date of Patent: Sep. 17, 2019

(54) WELDING GLOVE

(71) Applicant: Marcus Kimbrough, Moss Point, MS (US)

(72) Inventor: Marcus Kimbrough, Moss Point, MS (US)

( * ) Notice: Subject to any disclaimer, the term of this patent is extended or adjusted under 35 U.S.C. 154(b) by 15 days.

(21) Appl. No.: 15/619,695

(22) Filed: Jun. 12, 2017

(65) Prior Publication Data

US 2018/0352881 A1 Dec. 13, 2018

(51) Int. Cl.
*A41D 19/015* (2006.01)

(52) U.S. Cl.
CPC ..... *A41D 19/01529* (2013.01)

(58) Field of Classification Search
CPC .. A41D 19/01529; A41D 13/08; A41D 19/00; A41D 19/0006; A41D 19/0044; A41D 19/015; A41D 2600/202
USPC ..... 2/161, 161.6
See application file for complete search history.

(56) References Cited

U.S. PATENT DOCUMENTS 2,610,326 A 9/1952 Sabin
4,445,232 A 5/1984 Nelson
5,369,806 A * 12/1994 Chan ..... A41D 19/01529 2/161.6
5,745,919 A * 5/1998 Kraatz ..... A41D 19/01505 2/159
D651,358 S 12/2011 Bulan et al.
2004/0210981 A1* 10/2004 Jang ..... A41D 19/015 2/161.1
2004/0221366 A1* 11/2004 Jang ..... A41D 19/01529 2/161.6
2005/0010990 A1* 1/2005 Jang ..... A41D 19/01529 2/161.6
2014/0033392 A1* 2/2014 Bulan ..... A41D 19/01529 2/16
2017/0119069 A1* 5/2017 Alferez ..... A41D 19/0096
2018/0199642 A1* 7/2018 Clark ..... A41D 13/087

* cited by examiner

*Primary Examiner* — Anna K Kinsaul
*Assistant Examiner* — F Griffin Hall
(74) *Attorney, Agent, or Firm* — Global Intellectual Property Agency, LLC; Daniel Boudwin

(57) ABSTRACT

A welding glove is provided. The welding glove includes a plurality of finger portions including an index finger portion and middle finger portion having an exterior layer and intermediate layer that each include a diameter that is at least twice the diameter of the exterior layer and intermediate layer, respectively, of the thumb portion, the ring finger portion, and the pinky finger portion. In this way, when employing the welding glove, a user's trigger fingers include a larger cross-sectional area for actuating a welding trigger, which facilitates the absorption and redistribution of pressure on the user's fingers when actuating a welding trigger. In addition, the larger cross-sectional area aids in the absorption of any opposite force exerted onto a user's fingers by the welding trigger, thereby reducing the discomfort and stress associated with actuating a welding trigger for prolonged periods of time.

14 Claims, 4 Drawing Sheets

WELDING GLOVE

BACKGROUND OF THE INVENTION

The present invention relates to welding gloves. More specifically, the present invention relates to a welding glove including an index finger and middle finger portion that are at least twice the size of the remaining finger portions, for the purpose of facilitating the manipulation of a welding torch trigger and providing a means for alleviating the stress and discomfort associated with prolonged actuation of the welding torch trigger.

Welders typically wear protective clothing, such as welding gloves, to protect against the heat generated by a welding torch and to protect against sputtering metal generated during the welding process. During the welding process, a welder must squeeze the trigger of a welding torch for prolonged periods of time. Squeezing the trigger for such extended amounts of time can be quite painful to a user, in particular to his or her middle and index fingers since, typically, those are the fingers squeezing the trigger and enduring the majority of the stress. Over time, welders may develop disorders or conditions, such as arthritis, carpel tunnel, and the like to these fingers during this occupational exposure.

Currently, conventional welding gloves provide finger portions that include some padding but do not include index and middle finger portions that provide enough support configured to aid in squeezing a welding torch trigger and absorbing or alleviating the stress applied thereto.

It is therefore desirable to provide a welding glove with improved finger portions that provide more support to the fingers of a user when operating a welding torch.

SUMMARY OF THE INVENTION

In view of the foregoing disadvantages inherent in the known types of welding gloves now present in the prior art, the present invention provides a welding glove wherein the same can be utilized for providing convenience for the user when operating a welding torch.

In one embodiment of the present invention, the welding glove comprises a hand portion including a base, a back side, a palm side, a plurality of finger portions extending outwardly from the hand portion, an elongated cuff extending outwardly from the base in a direction opposing the plurality of finger portions, an exterior layer, a rigid intermediate layer, and an interior lining. The elongated cuff includes a length sized to extend over a user's wrist and forearm. The plurality of finger portions include a thumb portion, an index finger portion, a middle finger portion, a ring finger portion, and a pinky finger portion. Each of the plurality of finger portions are sized to receive a respective finger of the user. The exterior layer includes a flame retardant pliable material. The intermediate layer is disposed between the exterior layer and interior lining and includes a flame retardant foam. The exterior layer of the index finger portion and the middle finger portion includes a diameter ranging between twice a diameter and three times a diameter of the exterior layer of the thumb portion, the ring finger portion, and the pinky finger portion.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
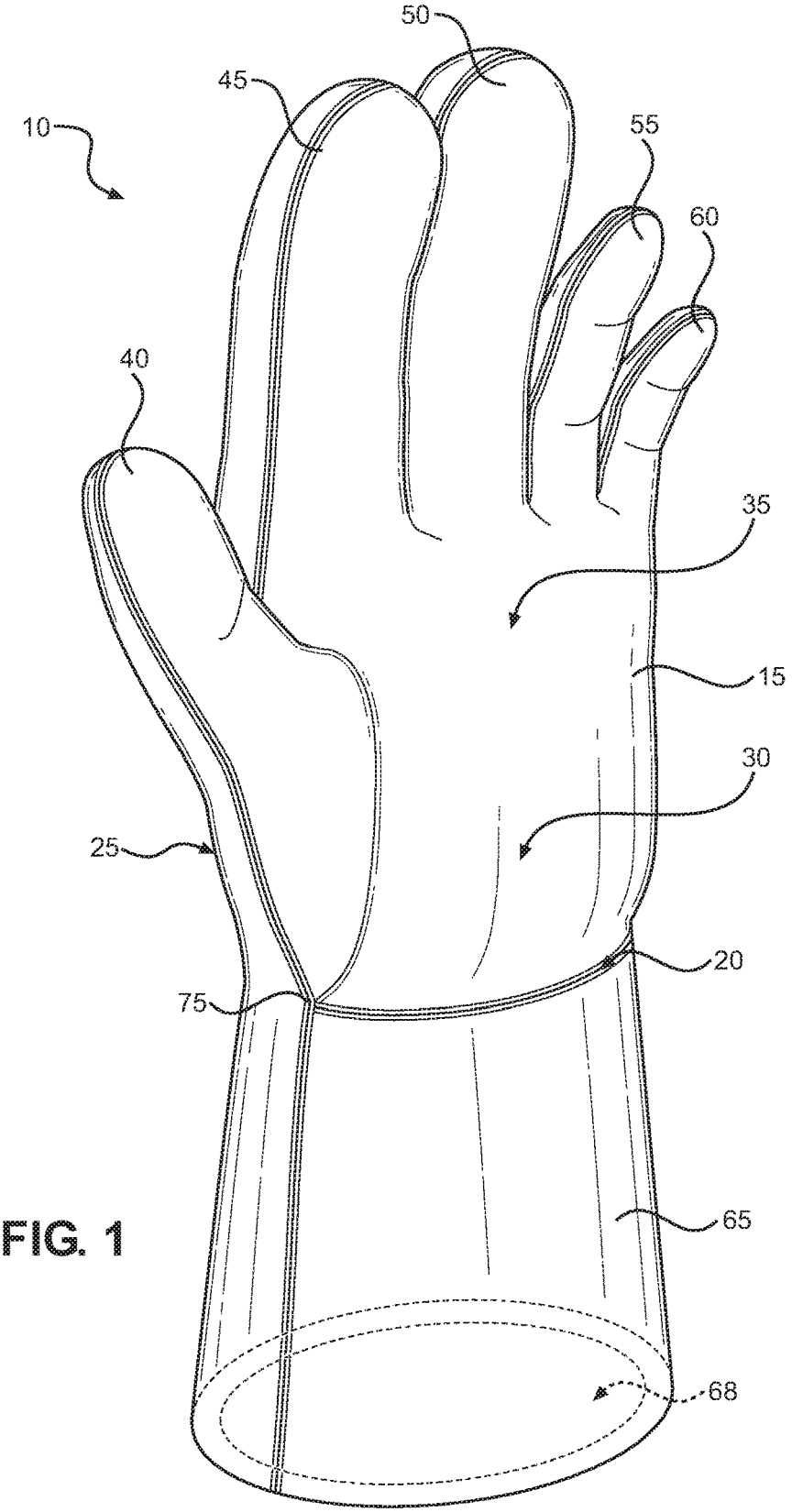
FIG. 1 shows a perspective view of the welding glove.

Reference is made herein to the attached drawings. Like reference numerals are used throughout the drawings to depict like or similar elements of the welding glove. The figures are intended for representative purposes only and should not be considered to be limiting in any respect.

Referring now to FIGS. 1-4, there are shown perspective views of the welding glove according to alternative embodiments of the present invention and a cross-sectional view of the index, middle, ring, and pinky finger portions of the welding glove, respectively. The welding glove 10 comprises a hand portion 15 including a base 20, a back side 25, a palm side 30, and a plurality of finger portions extending radially outwardly from a distal end 35 of the hand portion 15. The hand portion 15 includes an interior volume sized to receive a hand of a user therein. The plurality of finger portions include at least a thumb portion 40, an index finger portion 45, a middle finger portion 50, a ring finger portion 55, and a pinky finger portion 60. Each of the finger portions 40, 45, 50, 55, 60 includes an interior finger compartment 62 configured to receive a respective finger of a user's hand therein.

The welding glove 10 includes a cuff portion 65 extending outwardly from the base 20 in a direction opposite the plurality of finger portions. In the depicted embodiment, the cuff portion 65 is elongated, such as the cuff of a gauntlet, and is configured to cover a user's wrist and part of the user's forearm for providing more protection to a user's arm while welding. The cuff portion 65 includes an opening 68 which facilitates insertion of a user's hand into the interior volume of the hand portion 15.

The welding glove 10 comprises an exterior layer 70, the composition of which includes a heat resistant and durable material, such as silicon or a pliable leather, e.g., cowhide, deer hide, pig hide, elk hide, and goat hide. In one embodiment, to provide more durability and flame retardant properties, the welding glove 10 includes a flame retardant thread 75, e.g., Nomex® thread, Kevlar® thread, Poly FIRE® thread, and PTFE coated fiberglass thread. The welding glove 10 further includes a rigid intermediate layer 80, the composition of which includes a flame retardant foam, such as open-cell or closed-cell polyurethane foam and expanded polystyrene foam, and an interior lining 85, which is composed of a soft and supple material, such as cotton. The exterior layer 70 and interior lining 85 completely enclose the rigid intermediate layer 80 therebetween, such as by stitching or sewing.

Figure 3:
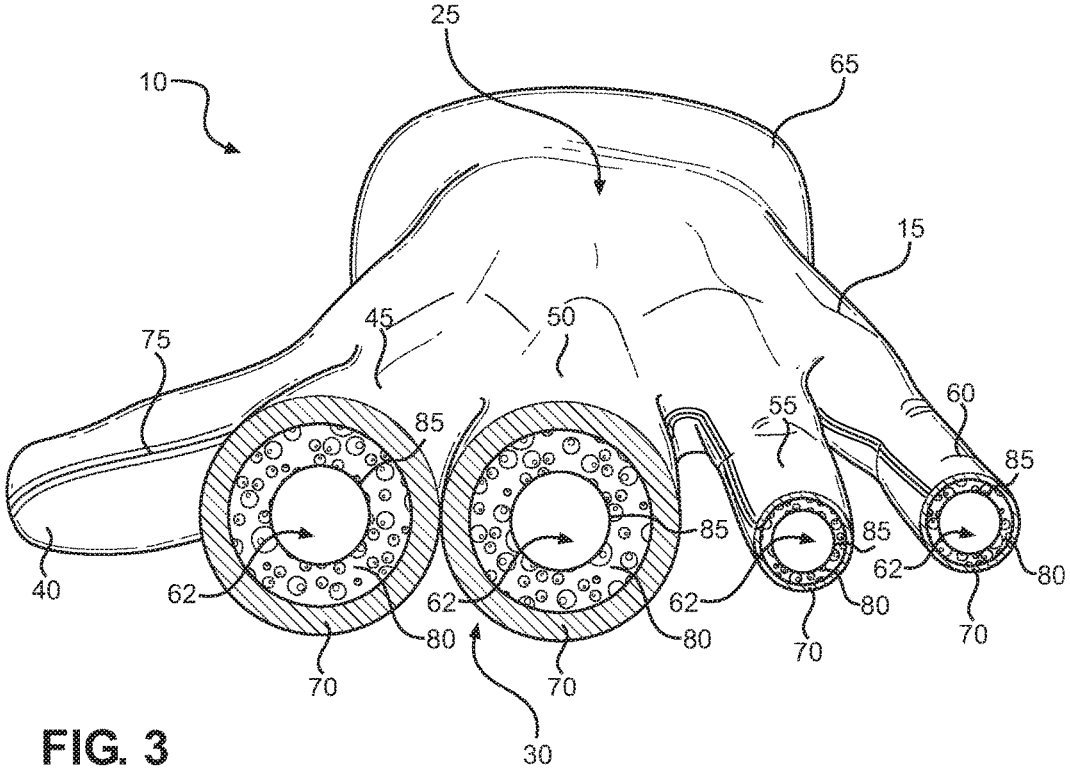
FIG. 3 shows a cross-sectional view of the index, middle, ring, and pinky finger portions of the welding glove.

In one embodiment, the exterior layer 70 and intermediate layer 80 of the index finger and middle finger portions 45, 50 each include a diameter, or thickness at least twice the size of the diameter, or thickness of the exterior and intermediate layers 70, 80 of the thumb, ring finger, and pinky finger portions 40, 55, 60 of the welding glove 10, as illustrated in FIGS. 1 and 3. In this way, a user's trigger fingers, i.e., the fingers utilized by a welder to actuate the trigger of a welding torch, e.g., the index and middle fingers portions 45, 50, include a larger cross-sectional area for actuating a welding trigger. In another embodiment, the diameter, or thickness of the exterior layer 70 and intermediate layer 80 of the index finger and the middle finger portions 45, 50 is three times the diameter, or thickness of the exterior and intermediate layers 70, 80 of the thumb, ring finger, and pinky finger portions 40, 55, 60.

The larger cross-sectional area created by the larger exterior and intermediate layers 70, 80 facilitates the absorption and redistribution of pressure on a user's trigger fingers when actuating a welding trigger. For example, when actuating a welding trigger, with the larger index finger and middle finger portions 45, 50, the exterior and intermediate layers 70, 80 act synergistically to absorb any opposite force exerted onto a user's index and middle fingers by the welding trigger, thereby reducing the standard stressful and painful force and discomfort associated with actuating a welding trigger for prolonged periods of time. The rigidity of the intermediate layer 80 further provides a spring, or bias, force that helps actuate the trigger while reducing the force exerted by a user's fingers during actuation. In this way, the intermediate layer 80 helps reduce an opposite force exerted by the welding trigger onto the user's fingers. Preferably, the diameter of the exterior and intermediate layers 70, 80 of the larger finger portions is between two and three times the size of the other smaller finger portions, such that the cross-sectional area of the larger finger portions is large enough to meaningfully diminish the force exerted on a user's trigger fingers and reduce discomfort.

Figure 2:
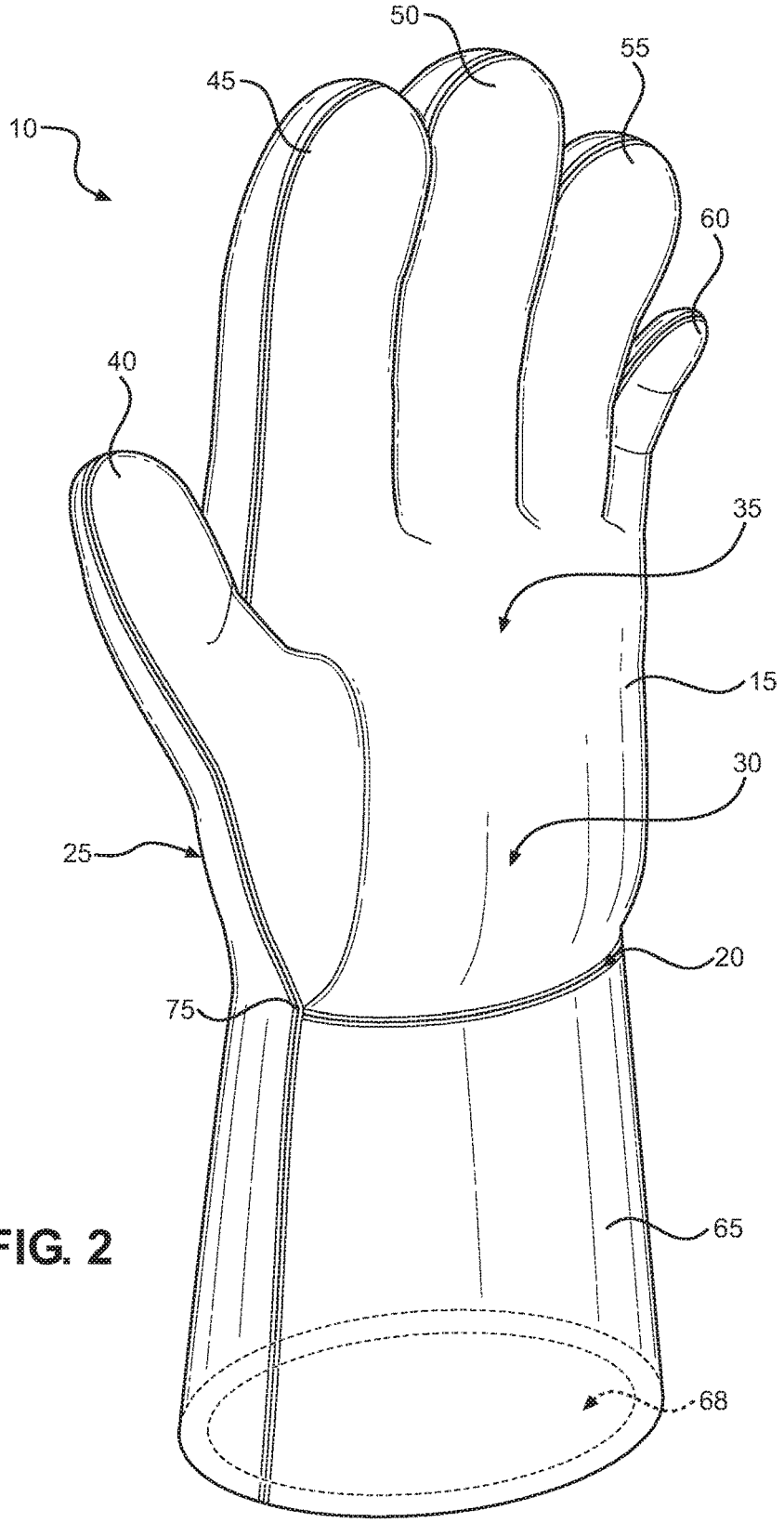
FIG. 2 shows a perspective view of the welding glove according to an alternative embodiment of the present invention.
Figure 4:
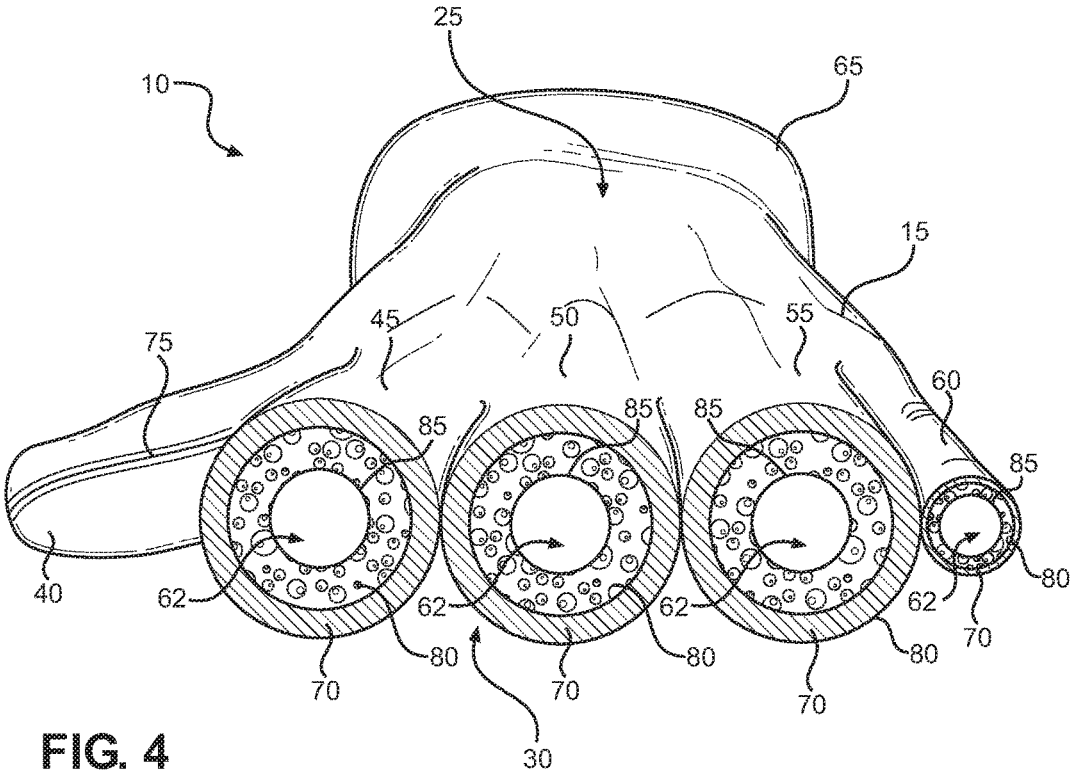
FIG. 4 shows a cross-sectional view of the index, middle, ring, and pinky finger portions of the welding glove according to an alternative embodiment of the present invention.

In another embodiment, the exterior layer 70 and intermediate layer 80 of the index finger, middle finger, and ring finger portions 45, 50, 55 each include a diameter at least twice the size of the diameter of the exterior and intermediate layers 70, 80 of the thumb and pinky finger portions 40, 60 of the welding glove 10, as illustrated in FIGS. 2 and 4. In this way, a user may opt to utilize a welding glove 10 including a larger cross-sectional area in the ring finger portion 55 for added support when actuating a welding trigger.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A welding glove, comprising:

a hand portion including a base, a back side, a palm side, a plurality of finger portions extending outwardly from the hand portion, and an elongated cuff extending outwardly from the base in a direction opposing the plurality of finger portions, the elongated cuff including a length sized to extend over a user's wrist and forearm;

the plurality of finger portions including at least a thumb portion, an index finger portion, a middle finger portion, a ring finger portion, and a pinky finger portion, each of the plurality of finger portions sized to receive a respective finger of a user;

an exterior layer including a flame retardant pliable material;

a rigid intermediate layer including a flame retardant foam; and wherein the exterior layer of the index finger portion and the middle finger portion includes a thickness ranging between twice a thickness and three times a thickness of the exterior layer of the thumb portion, the ring finger portion, and the pinky finger portion.

2. The welding glove of claim 1, wherein the flame retardant exterior layer comprises a pliable leather selected from the group consisting of cowhide, deer hide, pig hide, elk hide, and goat hide.

3. The welding glove of claim 1, wherein the intermediate layer of the index finger portion and the middle finger portion includes a thickness ranging between twice a thickness and three times a thickness of the intermediate layer of the thumb portion, the ring finger portion, and the pinky finger portion.

4. The welding glove of claim 3, wherein the intermediate layer comprises a flame retardant foam selected from the group consisting of open-cell polyurethane, closed-cell polyurethane foam, and expanded polystyrene foam.

5. The welding glove of claim 3, wherein a thickness of the exterior layer is equal to a thickness of the intermediate layer.

6. The welding glove of claim 1, further comprising stitching including a flame retardant thread.

7. The welding glove of claim 6, wherein the stitching comprises a flame retardant thread selected from the group consisting of Nomex® thread, Kevlar® thread, Poly FIRE® thread, and PTFE coated fiberglass thread.

8. A welding glove, comprising: a hand portion including a base, a hack side, a palm side, a plurality of finger portions extending outwardly from the hand portion, and an elongated cuff extending outwardly from the base in a direction opposing the plurality of finger portions, the elongated cuff including a length sized to extend over a user's wrist and along forearm; the plurality of finger portions including at least a thumb portion, an index finger portion, a middle finger portion, a ring finger portion, and a pinky finger portion, each of the plurality of finger portions sized to receive a respective finger of a user; an exterior layer including a flame retardant pliable material; a rigid intermediate layer including a flame retardant foam; and wherein the exterior layer of the index finger portion, the middle finger portion, and the ring finger portion includes a thickness ranging between twice a thickness and three times a thickness of the exterior layer of the thumb portion and the pinky finger portion.

9. The welding glove of claim 8, wherein the flame retardant exterior layer comprises a pliable leather selected from the group consisting of cowhide, deer hide, pig hide, elk hide, and goat hide.

10. The welding glove of claim 8, wherein the intermediate layer of the index finger portion, the middle finger portion, and the ring finger portion includes a thickness ranging between twice a thickness and three times a thickness of the intermediate layer of the thumb portion and the pinky finger portion.

11. The welding glove of claim 10, wherein the intermediate layer comprises a flame retardant foam selected from the group consisting of open-cell polyurethane, closed-cell polyurethane foam, and expanded polystyrene foam.

12. The welding glove of claim 10, wherein the thickness of the exterior layer is equal to the thickness of the intermediate layer.

13. The welding glove of claim 8, further comprising stitching including a flame retardant thread.

14. The welding glove of claim 13, wherein the stitching comprises a flame retardant thread selected from the group consisting of Nomex® thread, Kevlar® thread, Poly FIRE® thread, and PTFE coated fiberglass thread.

* * * * *